United States Patent [19]

Ikeda

[11] Patent Number: 4,526,487

[45] Date of Patent: Jul. 2, 1985

[54] MULTICOLOR INK RIBBON CASSETTE

[75] Inventor: Yoshiaki Ikeda, Tokyo, Japan

[73] Assignee: Seikosha Co., Ltd., Tokyo, Japan

[21] Appl. No.: 463,161

[22] Filed: Feb. 2, 1983

[30] Foreign Application Priority Data

Feb. 4, 1982 [JP] Japan ..... 57-16726

[51] Int. Cl.[3] ..... B41J 31/14; B41J 32/02

[52] U.S. Cl. ..... 400/201; 400/196.1; 400/202.4; 400/240; 400/240.4

[58] Field of Search ..... 400/201, 202, 202.4, 400/240, 240.4, 196.1, 202.2

[56] References Cited

U.S. PATENT DOCUMENTS

| | | | |
|---|---|---|---|
| 1,795,965 | 3/1931 | Pederira | 400/201 |
| 1,846,498 | 2/1932 | Stephenson | 400/201 |
| 2,005,503 | 6/1935 | Pelton | 400/202.4 |
| 2,531,692 | 11/1950 | Kreider | 400/201 |
| 3,232,406 | 2/1966 | Schwartz | 400/202.2 |
| 3,951,253 | 4/1976 | Tibay et al. | 400/201 |
| 4,153,378 | 5/1979 | Scherrer et al. | 400/202.2 |
| 4,395,148 | 7/1983 | Grüner et al. | 400/240.4 |

*Primary Examiner*—Edgar S. Burr
*Assistant Examiner*—David A. Wiecking
*Attorney, Agent, or Firm*—Robert E. Burns; Emmanuel J. Lobato; Bruce L. Adams

[57] ABSTRACT

A multicolor ink ribbon cassette comprises a cassette case containing a multicolor ink ribbon having plural lengthwise extending stripes of differently colored ink. A transfer roller transfers differently colored inks supplied from the wicks of respective ink cartridges to the ink ribbon stripes as the ink ribbon advances lengthwise through the cassette case. To reduce the thickness of the cassette case, the ink cartridges are all disposed in a common plane in angularly spaced relation about the transfer roller. At least two of the ink cartridges have the same shape and are arranged in the cassette case in upside down relation with respect to each other.

9 Claims, 9 Drawing Figures

MULTICOLOR INK RIBBON CASSETTE

BACKGROUND OF THE INVENTION

The present invention relates to a multicolour ink ribbon cassette for use in a dot printer which prints characters, drawings, or graphs in colour.

The present invention intends to provide a new ink ribbon cassette in which multicolour inks are supplied by ink cartridges.

SUMMARY OF THE INVENTION

According to a feature of the present invention there is provided a multicolour ink ribbon cassette comprising, a cassette case for a multicolour ink ribbon in plural stripes of colours, a transfer roller rotatably supported and provided with transfer rings which contact said ink ribbon and plural ink cartridges arranged around said transfer roller, each ink cartridge being provided with a lead protruding to contact with said transfer ring of said transfer roller.

One object of the present invention is to provide a multicolour ink ribbon cassette in which inks are supplied to an ink ribbon by ink cartridges.

Another object of our present invention is to provide a multicolour ink ribbon cassette in which the interior space of the cassette case is used effectively thereby making the cassette small-sized.

Further another object of the present invention is to provide a multicolour ink ribbon cassette in which streaks of colours in an ink ribbon do not mix with one another to thereby perform clear print.

BRIEF DESCRIPTION OF THE DRAWINGS

The above objects, other objects as well as and characteristic features of the present invention will become evident and will be more readily understood from the following description and claims taken in conjunction with the accompanying drawings in which;

DETAILED DESCRIPTION OF PREFERRED EMBODIMENT

Figure 1:
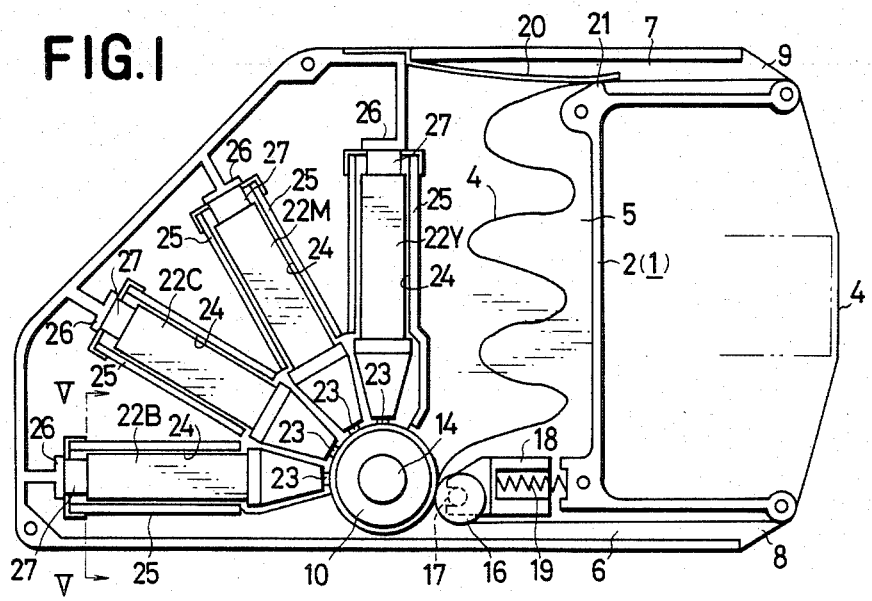
FIG. 1 is a plan view of a multicolour ink ribbon cassette of our present invention in which a cover is removed.
Figure 2:
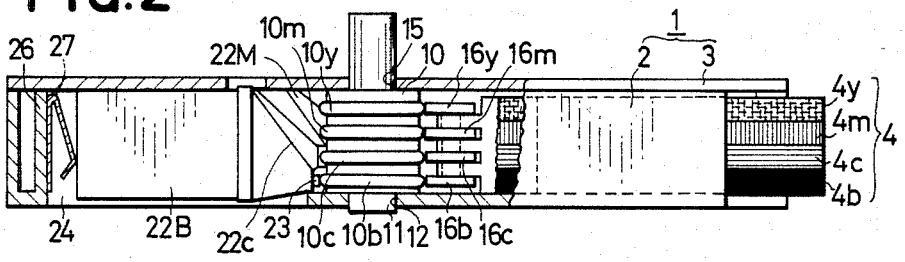
FIG. 2 is a vertical section of the multicolour ink ribbon cassette shown in FIG. 1.
Figure 3:
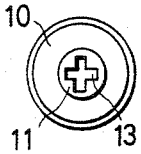
FIG. 3 is a bottom view of the transfer roller.
Figure 5:
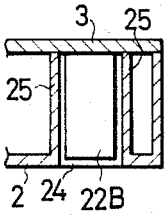
FIG. 5 is a sectional view along lines V—V in FIG. 1.
Figure 4:
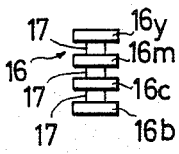
FIG. 4 is an elevational view of the follower wheel.

Referring to FIGS. 1 and 2, a cassette case 1 is composed of a lower case 2 having a major bottom side and a cover 3 having a major top side, and is provided with a sufficient space to accommodate a print head (not shown in the drawings). An endless ink ribbon 4 is impregnated with ink in four different colour stripes 4*y*, 4*m*, 4*c* and 4*b* which correspond respectively to three primary colours of yellow, magenta and cyan, and black. Some portion of the ink ribbon 4 is held in a slackened or meandering condition in a room 5. The ink ribbon 4 passes through an ink ribbon path defined by the room 5 passages 6, 7 and openings 8, 9. A transfer roller 10 is rotatably supported in the case along the ink ribbon path. The transfer roller 10 is provided with four transfer rings 10*y*, 10*m*, 10*c*, 10*b* in parallel and corresponding to the colours of the ink ribbon 4. Lower part 11 of the transfer roller 10 protrudes through a hole 12 bored in the lower case 2 and is provided with a crisscross cut 13 in the bottom as shown in FIG. 3. When the ink ribbon cassette is set to a print head, a drive shaft of the print head engages with the crisscross cut 13, and the transfer roller 10 is rotated in the counterclockwise direction in FIG. 1. Upper part 14 of the transfer roller 10 protrudes upward through a hole 15 in the cover 3 and can be rotated manually. A follower roller 16 abuts against the transfer roller 10 with the ink ribbon 4 interposed therebetween. The follower roller 16 is provided with four ridges 16*y*, 16*m*, 16*c* and 16*b* corresponding respectively to the transfer rings 10*y*, 10*m*, 10*c* and 10*b* of the transfer roller 10. The follower roller 16 is supported rotatably at its concaved portions 17 (FIG. 4) by a support member 18. The support member 18 is slidably supported by the lower case 2 and is pushed leftward in FIG. 1 by a spiral spring 19. By such a construction, the ink ribbon 4 is pushed or urged toward the transfer roller 10 by the follower wheel 16, and when the transfer roller 10 is rotated in the counterclockwise direction in FIG. 1, the ink ribbon 4 is rotated clockwise in FIG. 1. A lever spring 20 is provided in the passage 7. The lever spring 20 abuts against a projection 21 and the ink ribbon 4 passes therebetween frictionally so that appropriate tension is applied to the ink ribbon. Ink cartridges 22Y, 22M, 22C and 22B which respectively correspond to the four colours, yellow, magenta, cyan, and black are arranged in a common plane radially around the transfer roller 10 in side-by-side relationship. Leads or wicks 23 made of felt or the like project from the cartridges to contact with corresponding transfer rings 10*y*, 10*m*, 10*c* and 10*b* of the transfer roller 10. The ink cartridges 22Y, 22M, 22C and 22B are arranged in a single layer or row and can be easily set in and removed from rooms 24 provided in the lower case 2. The rooms 24 have downwardly extending openings as shown in FIG. 5. Springs 27 are provided in the spaces surrounded by side plates 25 and back plates 26. The springs 27 resiliently bias or push the ink cartridges 22Y, 22M, 22C, 22B toward the transfer roller 10.

Figure 6:
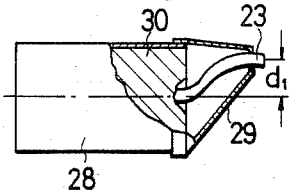
FIG. 6 is a vertical section of an ink cartridge.
Figure 7:
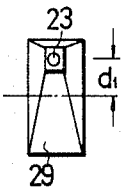
FIG. 7 is a front elevational view of the ink cartridge of FIG. 6.
Figure 8:
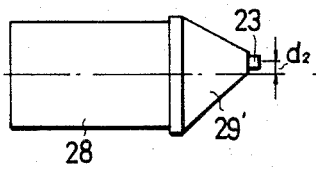
FIG. 8 is a side view of another ink cartridge.
Figure 9:
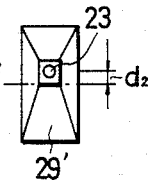
FIG. 9 is a front elevational view of the ink cartridge of FIG. 8.

The ink cartridges 22Y corresponding to the uppermost transfer ring 10*y* and the ink cartridge 22B corresponding to the lowermost transfer ring 10*b* are the same except that the colours of inks contained in the cartridges are different. In FIGS. 6 and 7, the ink cartridge 22Y includes a rectangular case 28 and a cap 29 and an ink-containing material 30 such as fiber or the like is stored therein. The lead 23 protrudes forward from the cap 29 at a vertical position which is deviated from the central line by the distance $d_1$. In case the ink cartridge 22Y is set in a state as shown in FIGS. 6 and 7 in which the lead 23 is deviated upward, the lead contacts the uppermost transfer ring 10*y*. Whereas the ink cartridge 22B, which is like the ink cartridge 22Y, is set in the room 24 upside down from the state of FIGS. 6 and 7, and its lead 23 is deviated downward to contact the lowermost transfer ring 10*b*. The ink cartridges 22M, 22C which correspond respectively to the transfer rings 10*m*, 10*c* are similar to each other except that the colours of inks contained in the cartridges are different. FIGS. 8 and 9 show the ink cartridge 22M, in which a cap 29' is provided with a hole located at a vertical position which is deviated from the center line by the distance $d_2$. The lead 23 protrudes through the hole to contact the transfer ring 10*m*. The ink cartridge 22C is set in the room 24 upside down from the state of the ink cartridge 22M shown in FIGS. 8 and 9 and the lead 23 is vertically deviated downward from the center line by the distance $d_2$ to contact the transfer surface 10*c*. As described above, the four cartridges 22Y, 22M, 22C, 22B can be obtained by employing only two different kinds of caps 29, 29'.

In operation, upon setting the ink ribbon cassette to the print head (not shown in the drawings), the transfer roller 10 is rotated as the print head moves and the ink ribbon 4 is rotated in the clockwise direction in FIG. 1. Inks are supplied to the transfer rings 10*y*, 10*m*, 10*c*, 10*b* respectively from the ink cartridges 22Y, 22M, 22C, 22B through the leads 23 and the inks are transferred to form the stripes of colours 4*y*, 4*m*, 4*c*, 4*b* of the ink ribbon as the transfer roller rotates. The four colours of inks are usually used unequally so that the inks in the ink cartridges are consumed at different times. Each ink cartridge can easily be replaced by a new spare ink cartridge when needed. The ink ribbon cassette can thus be used for a long time by simply replacing the exhausted ink cartridges timely until the cartridge is damaged too much to use. Then the ink ribbon cassette can be replaced by a new one.

In our present ink supply means employing ink cartridges, very small amounts of ink are supplied to the four stripes 4*y*, 4*m*, 4*c*, 4*b* and the ink ribbon does not contain excess ink. Therefore there is no danger of mixture of colours between the stripes of colours 4*y*, 4*m*, 4*c*, 4*b*.

The above embodiment describes an ink ribbon cassette having four colours, but our present invention may be also embodied in a three colour ink ribbon cassette, in which case the lead of the ink cartridge corresponding to the middle transfer ring is positioned on the center line.

The shape of the ink cartridge is not necessarily restricted to rectangular. Further, instead of the follower roller 16, a lever spring which abuts against the transfer roller 10 for feeding the ink ribbon in a tensioned state may be employed.

What is claimed is:

1. A multicolor ink ribbon cassette comprising: a cassette case having opposed top and bottom major sides; means defining an ink ribbon path for guiding the movement of an ink ribbon through the cassette case; a multicolour ink ribbon having plural lengthwise extending stripes of colored ink, the ink ribbon having at least a major portion thereof stored within the cassette case and being disposed for lengthwise movement along the ink ribbon path; ink transfer means disposed within the cassette case along the ink ribbon path for separately transferring colored inks supplied thereto to correspondingly colored ones of the ink ribbon stripes; and plural ink cartridges each containing a supply of a different one of the colored inks for supplying the same to the ink transfer means, the plural ink cartridges being disposed in angularly spaced relation about the ink transfer means with their center lines lying in a common plane, two of the ink cartridges being similar in shape and having an ink-supplying wick extending outwardly from one end thereof at a distance vertically spaced from the center line of the ink cartridge and the two similarly shaped ink cartridges being arranged in the cassette case in upside down relation with respect to each other so that their wicks contact the ink transfer means on opposite sides of the common plane at equal distances therefrom, and the plural ink cartridges being mounted for individual removal and replacement.

2. A multicolor ink ribbon cassette according to claim 1; wherein the ink transfer means comprises a transfer roller rotatably mounted within the cassette case for rotation about an axis extending transversely of the top and bottom major sides, the transfer roller having a plurality of rings axially spaced therealong each coacting with the ink-supplying wick of a corresponding ink cartridge to receive a supply of colored ink therefrom and transfer the same to the correspondingly colored ink ribbon stripe.

3. A multicolor ink ribbon cassette according to claim 2; wherein the ink transfer means further includes means for urging the ink ribbon into rolling contact with the transfer roller rings during lengthwise movement of the ink ribbon past the transfer roller.

4. A multicolor ink ribbon cassette according to claim 2; wherein the plural lengthwise extending stripes of colored ink comprises at least three stripes of differently colored ink.

5. A multicolor ink ribbon cassette according to claim 2; wherein one of the said two similarly shaped ink cartridges is mounted so that its ink-supplying wick contacts the bottommost transfer roller ring which is disposed closest to the cassette case bottom side and the other of the said two similarly shaped ink cartridges is mounted upside down with respect to said one ink cartridge so that its ink-supplying wick contacts the topmost transfer roller ring which is disposed closest to the cassette case top side.

6. A multicolor ink ribbon cassette according to claim 5; wherein the cassette case includes a removable cover which comprises the top major side of the cassette case.

7. A multicolor ink ribbon cassette according to claim 1; wherein the thickness of the cassette in the direction between the opposed inner surfaces of the top and bottom sides corresponds essentially to the thickness of each ink cartridge.

8. A multicolor ink ribbon cassette according to claim 7; wherein all of the ink cartridges have the same thickness.

9. A multicolor ink ribbon cassette according to claim 1; wherein the plural lengthwise extending stripes of colored ink comprises at least three stripes of differently colored ink.

* * * * *